US006658906B1

(12) United States Patent
Wright

(10) Patent No.: US 6,658,906 B1
(45) Date of Patent: Dec. 9, 2003

(54) DOORKNOB DISABLING DEVICE

(76) Inventor: James H. Wright, 1406 Mackinaw Ave., Cheboygan, MI (US) 49721

( * ) Notice: Subject to any disclaimer, the term of this patent is extended or adjusted under 35 U.S.C. 154(b) by 0 days.

(21) Appl. No.: 10/054,200

(22) Filed: Jan. 22, 2002

Related U.S. Application Data

(60) Provisional application No. 60/263,349, filed on Jan. 22, 2001.

(51) Int. Cl.[7] ..... E05B 17/18; E05B 13/00; E05B 17/14

(52) U.S. Cl. ..... 70/455; 70/416; 70/424; 70/DIG. 58; 292/292; 292/DIG. 2

(58) Field of Search ..... 70/416, 423, 424, 70/428, 455, 209, DIG. 58; 292/DIG. 2, 288, 289, 292, 295

(56) References Cited

U.S. PATENT DOCUMENTS 2,883,850 A * 4/1959 Falck ..... 70/431
3,245,240 A 4/1966 Forrest
3,739,608 A 6/1973 Young
3,773,369 A * 11/1973 Wersonick ..... 292/150
4,007,956 A * 2/1977 Harris et al. ..... 292/347
4,127,967 A * 12/1978 Franzl ..... 49/171
4,155,578 A * 5/1979 Rolland ..... 292/292
4,285,221 A 8/1981 Atchisson
4,503,692 A * 3/1985 Grint ..... 70/418
4,575,140 A * 3/1986 Dargis ..... 292/288
4,876,867 A * 10/1989 Leneave ..... 70/420
5,425,256 A 6/1995 Crosby
5,560,235 A 10/1996 Aucoin
5,775,149 A * 7/1998 Small ..... 70/416
5,934,122 A 8/1999 Edwards et al.
6,416,089 B1 * 7/2002 Williams, Jr. ..... 292/288

* cited by examiner

*Primary Examiner*—Lloyd A. Gall
*Assistant Examiner*—Michael J. Kyle
(74) *Attorney, Agent, or Firm*—Douglas S. Bishop

(57) ABSTRACT

A device for temporarily disabling a doorknob attached to a hinged door. The device covers the doorknob with a rigid enclosure, preventing rotation of the doorknob to move the associated locking bolt. A retaining unit is mated with an extension from the rigid enclosure in a male-female relationship, simultaneously with fitting the retaining unit over the outer edge of the hinged door while ajar. Closure of the door into the associated doorjamb, with the enclosure over the doorknob, prevents parting movement between the enclosure and the retaining unit, providing a self-locking feature.

20 Claims, 4 Drawing Sheets

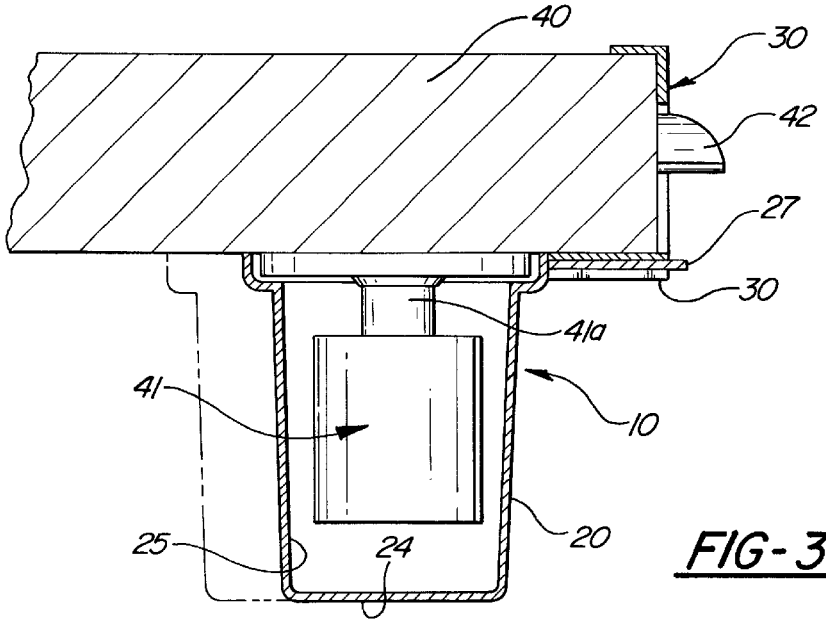
FIG-3
FIG-4
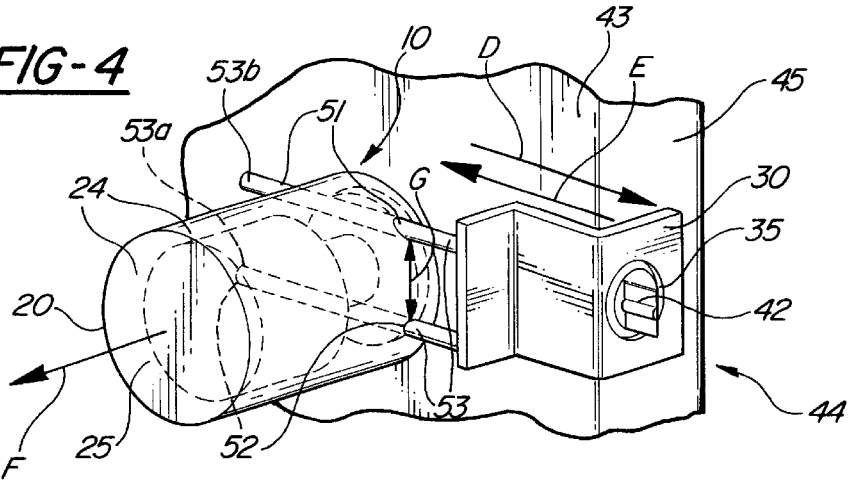
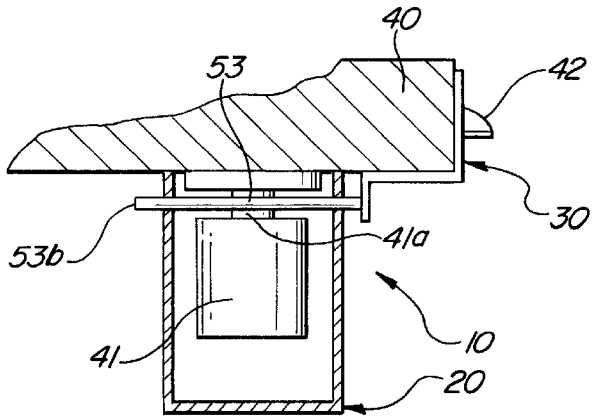
FIG-5

DOORKNOB DISABLING DEVICE

This application claims the benefit of provisional application 60/263,349 filed Jan. 22, 2001.

BACKGROUND OF THE INVENTION

The concept of placing a cover enclosure over a rotational doorknob, to prevent rotation of the doorknob, and concurrent dislodging of the associated locking bolt, and, finally, opening of an associated door, is, generally known. U.S. Pat. No. 4,285,221, to Atchisson, discloses a retrofit doorknob lock apparatus, in which a shroud is placed over the doorknob and the doorknob shaft and a clevis fits through slots in the shroud to retain the shroud in place. The clevis is locked in place with a separate exterior lock, on the same side of the door. Similarly, U.S. Pat. No. 3,739,608, to Young, discloses an auxiliary door lock including a doorknob cover, a resilient band along the inner wall surface of the cover, and a locking means, again on the same side of the door, utilizing a separate, exterior lock. The door lock of U.S. Pat. No. 4,876,867, to Leneave, again discloses a cover, comprised of a tubular casing, which fits over a doorknob, on one side of the door, with a locking lever, utilizing a separate lock, again, on the same side of the door. U.S. Pat. No. 5,425,256, to Crosby, for a doorknob security device, also utilizes a cover mechanism, kept in place by a separate lock, on the same side of the door. The lockable doorknob enclosure of U.S. Pat. No. 5,560,235, to Aucoin, again deals with an enclosure which fits over a doorknob to prevent rotation of the knob, and which has an incorporated locking mechanism, requiring a separate key, again, on the same side of the door as the mechanism.

As is indicated from review of the referenced prior art, all of the mechanisms shown for disabling a doorknob require an additional locking mechanism, either with an incorporated lock and key, or by requiring a separate, external lock, which would require either a combination or key to open. None of the devices shown in the prior art allow the disabling function to be completed by simply placing the door ajar, fitting the device into place, and closing the door, thereafter allowing entry only by activation of the doorknob from the opposite side. Correspondingly, the devices of the prior art do not permit removal of the device, once locked in place, simply by opening the associated door from the opposite side and removing the device by simple reverse sequence of its installation, without the need to separately unlock a separate attached security device.

Accordingly, a need exists for a doorknob disabling device, of a two piece construction, which may be put in place in a simple sequence, by placing the associated door ajar, placing a cover over the doorknob and mating a retaining mechanism with the doorknob cover, by movement of the retaining mechanism toward the cover, and closing of the door, so that the cover and retaining mechanism may not be disassociated while the door is closed, because of the position of the associated door jam, and its contact with the retaining mechanism, and the associated doorknob and its contact with the cover.

A need for such a device is particulary apparent in industries such as the mobile home sales industry, to prevent prospective customers from unnecessarily opening, and leaving unlocked, different access doors, during the course of their investigation of the product.

Likewise, the prior art does not provide a doorknob disabling device which may be placed over a knob on a associated door, on the side for gaining entry, and closed by a person temporarily occupying the interior space to which the door provides access, when there is a need for personal security in such space.

The present invention is directed toward a device with a minimum of components and moving parts, which does not require a separate locking mechanism, and addresses the shortcomings of the prior art.

SUMMARY OF THE INVENTION

The present invention is directed to a locking device, generally, and, in particular, to a doorknob disabling device which is utilized with a standard doorknob, which may or may not have a key on the knob on the side of the door from which access may still be gained, and, in some cases, having a manual locking or unlocking device on the portion of the doorknob on the interior or opposing side of the door. The device may, however, be utilized on any doorknob, even one without locks on either side, to disable the doorknob from the side of the door on which the device is affixed, when the door is closed within its associated doorjamb.

The device is designed, primarily, to be utilized to cover the knob on the side of the door which does not require a key, and from which the door may be manually locked or unlocked, so that, when the door is closed, the door may only be unlocked, as a prelude to opening, by utilizing the key from the exterior side of the door.

The device may be constructed of an rigid, non-permeable material. It is ideally constructed of metal. Plastic, acrylic or other material may be utilized. The device consists of a hollow cylinder, cup, or other enclosure having an open end, in which to accept a doorknob, and being otherwise, externally closed. This member is constructed, generally, so that it has the appearance of a cylinder, glass, or cup, but, in theory, may be of any shape, so long as there is a unitary, rigid exterior surface, completely enclosing the doorknob, when the doorknob is inserted or covered through the open end. The enclosure may be of a variation of sizes, and is generally configured to fit as snugly as desired over a doorknob, so that the open end rests against the planar surface of the door upon which the knob is attached. The cylinder may be long enough to accommodate varying doorknobs while maintaining contact with the door. While the interior portion of the closed end of the covering enclosure may touch the outer surface of the doorknob when the open end of the enclosure is in contact with the planar surface of the door, it is not necessary that it do so, and the device works equally well when the interior of the enclosure is actually contacting the knob, or where there is a space between the exterior knob surface and interior surface of the enclosure.

The device may constructed in different sizes, to accommodate different diameters of doorknobs, but the device will operate as intended, so long as the interior portion of the enclosure is of greater diameter than the diameter of the doorknob. If desired, rings or spacers may be placed around the interior of enclosure to make the interior diameter of the enclosure more closely conform to the outer diameter of the knob, if a close fit is particularly desired. As stated, it is not necessary for this fit to be close in any particular relative dimension, other than that the space between the exterior circumference of the knob and the interior surface of the enclosure must be less than the distance of the insertion of the mating extension from the enclosure into the female mating receptacle on the retention device, so that sideways movement of the enclosure will be impeded by the knob, prior the point where the mating relationship may be disengaged.

The enclosure has an opening, which is basically formed by a truncated section, so that the opening has an edge surface, substantially in a singular plane, which corresponds with and contacts the planer surface of the associated door. Either in the same plane, or in a plane parallel thereto, the enclosure member has a mating extension which extends outward toward the outer edge of the door, when the enclosure is in place over the doorknob.

A second detachable retaining member is conformed to fit over the width of the door edge approximate to the where the doorknob and lock assembly to be disabled is located. The retaining member is, preferably, a flat piece, conformed by bending to contact, by corresponding planar surfaces, the side of the door on which the knob to be disabled is located, the opposing side of the door, and the exterior edge of the door extending between them. The retaining member is fitted with a receptacle member, to accept and rigidly contain the extension from the enclosure, in a male-female relationship, when the enclosure is placed over the doorknob, and the retaining member is then placed over the edge of the door as described. The portion of the retaining member which forms the female receptacle portion of the mating relationship may be a complete enclosure, or may be partially cut away leaving overlapping flanges at the edges to hold extension firmly in place. The portion of the retaining member which contacts the planar edge of the door also is conformed to provide an opening sufficient for the locking bolt of the doorknob locking assembly to pass through.

The device is put in place when the associated door is ajar. Accordingly, when the associated door is closed, within its associated doorjamb, the enclosure may not be removed from the doorknob, because disassociating motion along the plane of the door is prevented by contact between the interior of the enclosure and the doorknob assembly and contact by the exterior portion of the retention member, and the associated doorjamb. Further, the enclosure may not be moved away from contact with the door, around the doorknob, because of the portion of the retaining member which is bent around the edge of the door, and which contacts the opposite surface of the door, and because of the dual retaining function provided when the locking doorknob assembly bolt passes through the opening in the retention member and locks into the associated receptacle in the doorjamb.

In another embodiment of the invention, the enclosure member alternatively is provided with two parallel pairs of apertures, with each pair aligned linearly parallel to the surface of the associated door and perpendicular to the plane of the exterior edge of the door, with a corresponding parallel pair of rods mounted on the retention member and fitting within and through the parallel pairs of apertures in male-female relationship.

Other objects, advantages and novel features of this invention will be set forth and will become apparent in the detailed description which follows.

BRIEF DESCRIPTION OF THE DRAWINGS

The following detailed description is best understood with reference to the following drawings, in which:

FIG. 3 is a sectional top view of the device in place on an associated door;

FIG. 4 is perspective view of the an alternative embodiment of the device in place on an associated door, showing, in transparency, the relationship of the device with a doorknob on the associated door;

FIG. 5 is a sectional top-view of an alternative embodiment of the device in place on an associated door.

DETAILED DESCRIPTION OF THE PREFERRED EMBODIMENT

Figure 1:
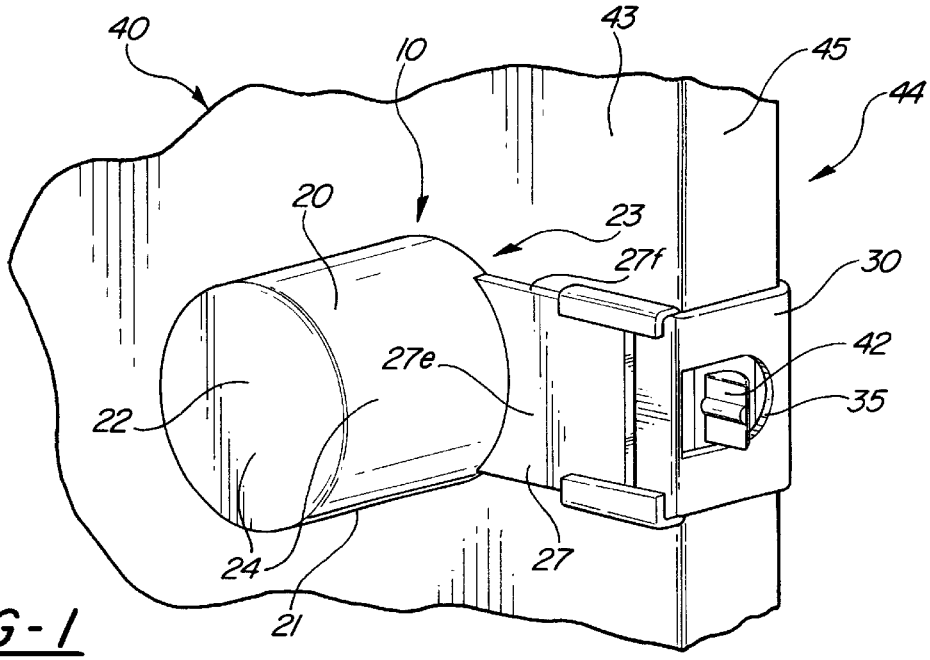
FIG. 1 is a perspective view of the device, in mated position covering a doorknob and secured over the outer edge of an ajar door.

The invention doorknob disabling device 10, broadly considered, includes an enclosure member 20 and a retention member 30. The doorknob disabling device is intended for use on an associated hinged door 40 having a doorknob assembly 41 which engages a locking bolt 42. Such a door 40 generally has a planar interior surface 43 upon which the doorknob assembly 41 is mounted, a corresponding planar exterior surface 44 and a planar outer edge surface 45, substantially perpendicular to the interior surface 43 and exterior surface 44, and running between them. The locking bolt 42 extends from and retracts into the outer edge surface 45, roughly proximate the doorknob assembly 41.

Enclosure member 20 in the preferred embodiment is a hollow cylinder 21, having a closed outer first end 22 and an open second end 23. The cylinder 21 is truncated to form the open end 23. Cylinder 21 has a rigid unitary outer surface 24 and a unitary inner surface 25. The truncated open end 23 provides a continuous opening edge 26 of the outer surface 24 and inner surface 25 in a substantially singular plane as demonstrated in the cross-sectional views of FIGS. 3 and 5, which is proximate to and contacts the planar interior surface 43 of the associated door 40. While the preferred embodiment of enclosure member 20 is a cylinder 21, enclosure member 20 may be of varied exterior shapes, including, but not limited to, the shown cylinder 21, a cup, or a truncated sphere, so long as the outer surface 24 is rigid and unitary, the edge 26 of the open end 23 is substantially planar, and the enclosure member 20 is sufficiently hollow to cover a doorknob 41 when the open end 23 is in contact with the associated door surface 43, as shown in FIGS. 1, 2, 3, 4, 5 and 6.

Attached to enclosure member 20 is a rigid mating extension 27, extending outward from member 20 proximate to opening 23 and substantially parallel to the plane thereof. In the preferred embodiment of the invention, extension 27 is a flat bar member having an upper edge 27*a*, a lower edge 27*b*, defining a height A, and a first end 27*c* proximate to cylinder 21 and an outer second end 27*d*, defining a length B. Extension 27 is of sufficient thickness or width 28 along its length B and height A to provide a rigid connection with retention member 30 when mated as shown in FIG. 1. Extension 27 further has a flat outer surface 27*e* and a flat inner surface 27*f*.

Retention member 30, in the preferred embodiment, is a flat bar unit, having an outer surface 31 and an inner surface 32. Member 30 is conformed in a substantial "u" shape to provide a first side 30*a*, a second, parallel, opposing side 30*b*, and a bridging, perpendicular end section 30*c*. Member 30 if further conformed to fit over the edge 45 of associated door 40, with the inner surface 32 of first side 30*a* in planar contact with interior surface 43, inner surface 32 of opposing side 30*b* in planar contact with exterior surface 44, and inner surface 32 of end section 30*c* in planar contact with outer edge surface 45, when member 30 is moved into place as shown in FIGS. 1 and 2.

Figure 2:
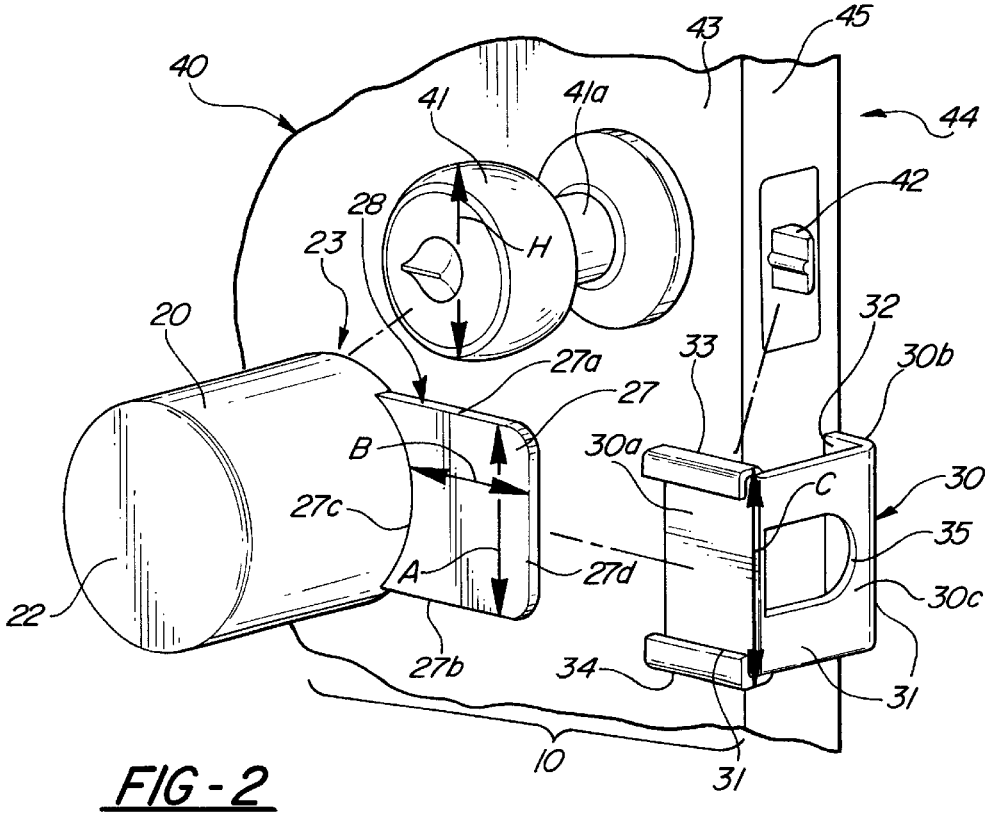
FIG. 2 is an exploded view of the components of the device showing the relationship between the device and an associated doorknob and door, as well as the mating association of the components of the device when in place.
Figure 6:
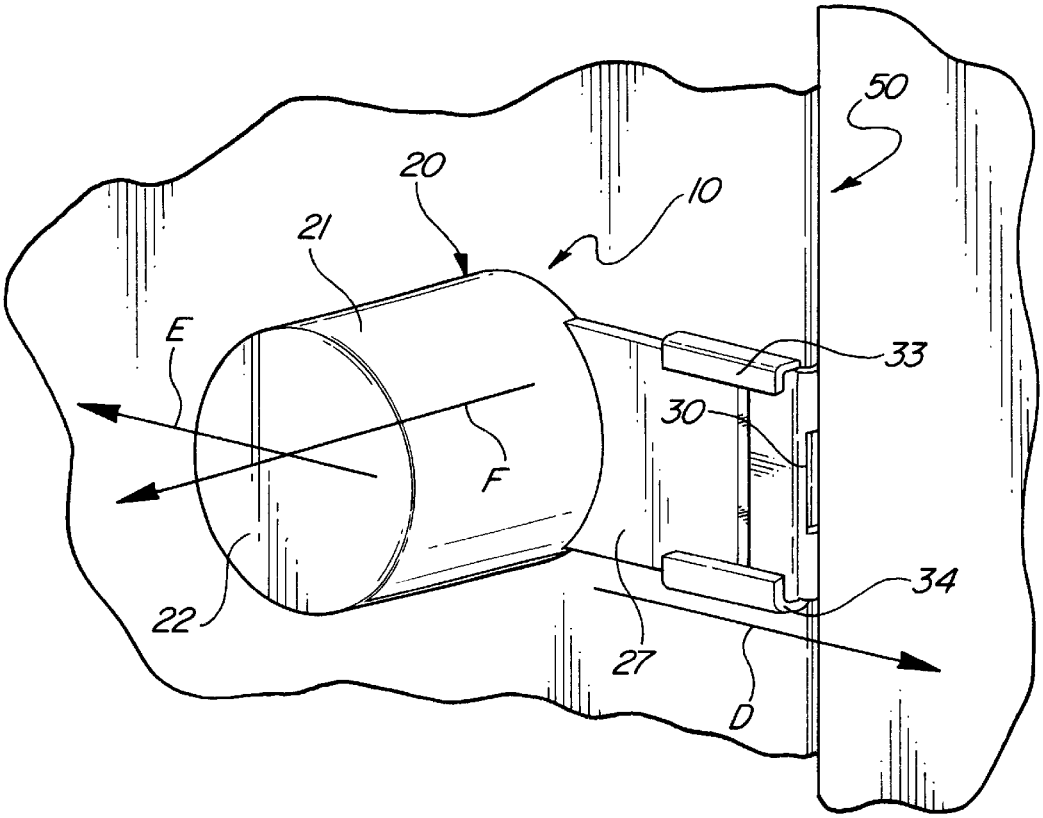
FIG. 6 is a perspective view of the device, in mated position covering a doorknob and secured over the outer edge of a closed door.
Figure 7:
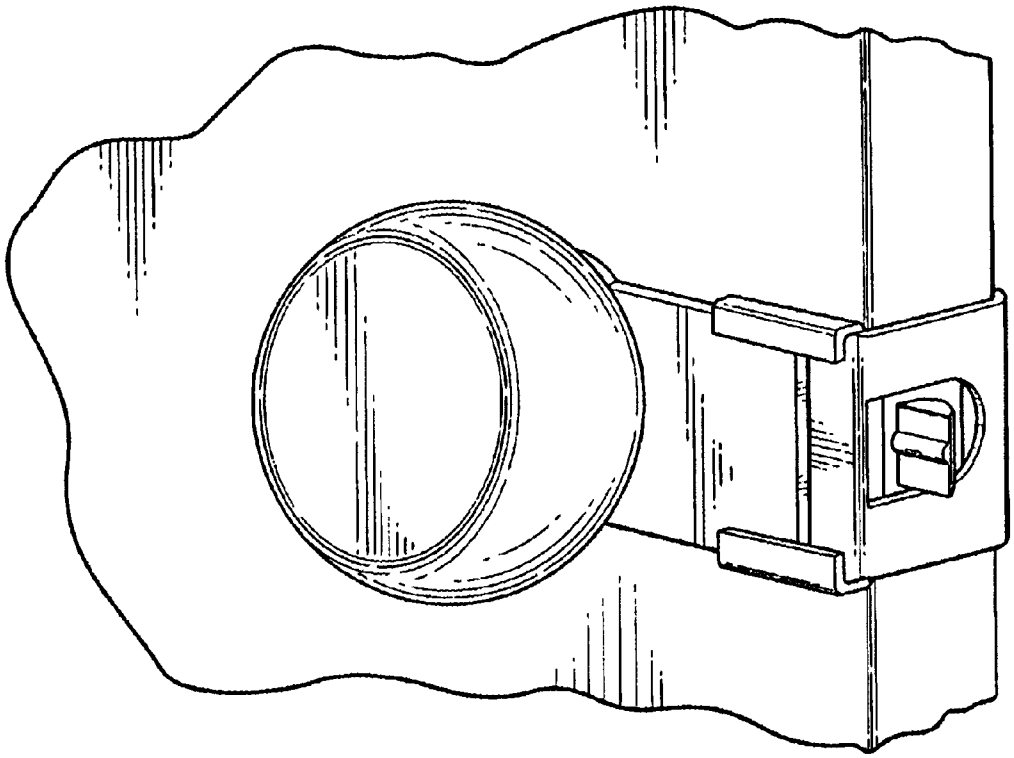
FIG. 7 is a perspective view of the device in mated position covering a door knob and secured over the outer edge of a closed door, demonstrating the enclosure means in the shape if a truncated sphere.

First side 30*a* of retention member 30 is further configured to receive mating extention 27 in a rigid coupling relationship as shown in FIG. 1, by relative contacting movement as shown in FIG. 2.

Retention member 30 has an upper edge 33 and lower edge 34 defining a height dimension C. In the preferred embodiment, upper edge 33 and lower edge 34 are each flanged to traverse the width 28 of extension 27 along upper edge 27*a* and lower edge 27*b* and a portion of the length B of outer surface 27*e*.

Extension member 27 and first side 30*a* are further conformed so that height dimension C is at least as long as height A, so that member 27 is slidably insertable within the flanged edges 33 and 34 and, when so inserted, is rigidly held there in a male-female relationship.

In another preferred embodiment the flanged ends 33 and 34 may be extended across height dimension C, and joined so that first side 30*a* of retention member 30 completely encircles extension member 27 when coupled in male-female relationship. Extension member 27 may be configured as a rod or other shape so long as first side 30*a* is correspondingly configured to provide a rigid male-female coupling when the outer second end 27*d* is fully inserted into the receptacle of first side 30*a*. In whatever configuration or shape extension member 27 and the first side 30*a* of retention member 30 are provided, the mating movement between extension member 27 and first side 30*a* is substantially in a singular plane parallel to the plane of opening edge 26 and perpendicular to planar outer edge surface 45 of the associated door.

In the preferred embodiment, an opening 35 is also provided in end section 30*c* of retention member 30. The opening 35 is provided large enough to permit passage through it of the locking bolt 42 when the locking bolt 42 is extended from outer edge surface 45, as shown in FIG. 1.

The device 10 is installed and made operative by placing the enclosure member 20 over the doorknob assembly 41 on the side of the associated door 40, so that the open edge 26 is parallel to and in contact with the planar interior surface 43, with the mating extension 27 extending outwardly and generally perpendicular to outer edge surface 45. While the door 40 is ajar, retention member 30 is moved toward enclosure member 20, until inner surface 32 of end section 30*c* is in planar contact with outer edge surface 45 of door 40, and positioned so that locking bolt 42 is moveable through opening 35, extension member 27 inserted within the flanged edges 33 and 34 of first side by doorjamb 50. Any substantial movement of enclosure member 20 in direction E is prevented by doorknob assembly 41, and movement of both enclosure member 20 and retention member 30 away from contact with the associated door 40 is prevent by the dual functions of bolt 42 extending through opening 35, and the contact of inner surface 32 of opposing side 30*b* with exterior surface 44. When the associated door 40 is opened and again ajar, the device may be removed by reverse sequence.

The entire device 10 may be constructed of metal or other rigid synthetic material such as plastic or acrylic matter.

An alternative embodiment of the device 10 is shown in FIGS. 4 and 5, wherein the mating function between enclosure member 20 and retention member 30 is provided by a pair of linear apertures 51 extending through enclosure member 20, linearly aligned so as to be perpendicular to edge surface 45 above stem 41*a* of doorknob assembly 41, and a corresponding second pair of apertures 52 extending through enclosure member 20 linearly aligned parallel to linear apertures 51 and in the same plane parallel to the plane of opening edge 23, with the distance G between the corresponding pairs 51 and 52, being less than the largest diameter H of doorknob assembly 41. Retention unit 30 is correspondly conformed to provide the parallel rods 53 attached to side 30*a* with outer ends 53*a* and 53*b* linearly aligned to be insertable through aperture pairs 52 and 51, respectively, when inner surface 32 of end section 30*c* contacts outer edge surface 45 with aperture 35 centered to allow passage by locking bolt 42. Motion in directions E & D is prevented in the same manner by doorjamb 50 and doorknob assembly 41, while motion in direction F is additionally inhibited by contact of rods 53*a* and 53*b* against doorknob assembly 41.

WHEREAS, a preferred embodiment of the invention has been illustrated and described in detail, it will be apparent that various and additional changes may be made in the disclosed embodiment without departing from the spirit of the invention.

What is claimed is:

1. A doorknob disabling device for utilization on a doorknob affixed to a hinged door, comprising:

a rigid enclosure means, truncated to provide an opening, substantially in a singular plane, conformed to fit over and enclose a doorknob with said opening substantially flush to a supporting door;

a retention means, conformed to removably engage an ajar door edge and further conformed to define an aperture in the portion thereof which contacts the outer end of the surface of the door, of sufficient dimension to allow passage of a locking bolt which is irremovable when said door is closed; and a mating means wherein said enclosure means and retention means are rigidly mated by sequential placement of the enclosure means and the retention means.

2. The doorknob disabling device of claim 1, wherein said enclosure means and retention means are mated in male-female relationship.

3. The doorknob disabling device of claim 1, wherein said enclosure means is a hollow cylinder having a closed and open end.

4. The doorknob enclosure device of claim 1, wherein said enclosure means is a truncated sphere.

5. A doorknob disabling device for utilization on a doorknob affixed to a hinged door, comprising:

a rigid enclosure means, truncated to provide an opening, substantially in a singular plane, conformed to fit over and enclose a doorknob with said opening substantially flush to a supporting door;

a retention means, comprising a plurality of angularly conformed planar sections conformed to simultaneously substantially contact the front, back and outer end surfaces of a supporting door, which is irremovable when said door is closed; and a mating means wherein said enclosure means and retention means are rigidly mated by sequential placement of the enclosure means and the retention means.

6. The doorknob disabling device of claim 1, wherein said mating means further comprises a member affixed to and extending from said enclosure means parallel to the plane of said opening and a receptacle attached to said retention means conformed to accept and retain said member in a male-female relationship.

7. The doorknob disabling device of claim 1, wherein the components thereof are constructed of metal.

8. The doorknob disabling device of claim 1, wherein the components thereof are constructed of rigid, synthetic matter.

9. The doorknob disabling device of claim 5, wherein said retention means is further conformed to define an aperture in the portion thereof which contacts the outer end surface of the door, of sufficient dimension to allow passage of a locking bolt.

10. The doorknob disabling device of claim 1, wherein said mating means comprises two or more linear pairs of apertures defined by the enclosure means and two or more corresponding rods extending from said retention means, each rod being received and retained by one linear pair of apertures in male-female relationship.

11. The doorknob disabling device of claim 10, wherein at least one linear pair of apertures and one corresponding rod is above the axis of the doorknob assembly and at least one pair of apertures and one corresponding rod is below the axis of the doorknob assembly and the distance between said corresponding rods is less than the maximum diameter of the associated doorknob.

12. The doorknob disabling device of claim 10, wherein said retention means comprises a plurality of angularly conformed planar sections conformed to simultaneously contact the front, back and outer end surfaces of a supporting door.

13. A doorknob disabling device for utilization on a doorknob affixed to a hinged door, comprising:

a hollow enclosure member having a unitary rigid outer surface and a unitary inner surface;

said hollow enclosure member being truncated so as to define an opening in said outer surface and inner surface in a single plane;

a rigid first mating member having a length, height and width dimension, a first end affixed to said enclosure member, and a second extending outwardly therefrom in parallel with the plane of said opening;

a retention member comprised of two opposing parallel planar side members each having an outer surface and an inner surface defining a uniform width between them, an open top, open bottom, open end and a closed end;

said closed end of said retention member being further conformed to define an aperture therein of sufficient dimension to allow passage of a locking bolt;

said side members being joined at said closed end by a planar end member extending between them in a perpendicular plane;

a second mating member attached to said retention member on the outer surface of one of the side members; and a coupling means, wherein said first mating member is rigidly coupled with said second mating member in male-female relationship by movement of the open end of said retention member toward the second end of said first mating member with the plane of said open end of said retention member being perpendicular to the length of said first mating member.

14. The doorknob disabling device of claim 13, wherein said enclosure member is a cylinder.

15. The doorknob disabling device of claim 13, wherein said enclosure member is conformed to accept within it and enclose a doorknob, with the plane of said outer surface being adjacent to and contacting the surface of a supporting door.

16. The doorknob enclosure device of claim 13, wherein the uniform width between said opposing planar side member is equal to or greater than the width of a supporting door and the open end of said retention member is conformed to slidably fit over the exterior edge of a supporting door.

17. The doorknob disabling device of claim 13, wherein the inner surface of one of the parallel side members and the opening in the hollow enclosure member both contact the same surface of a supporting door with the enclosure member enclosing a doorknob, and the mating members are slidably mateable in male-female relationship by sequentially placing the enclosed member and retention member in place on a door while ajar.

18. The doorknob disabling device of claim 13, wherein the components thereof are constructed of metal.

19. The doorknob disabling device of claim 13, wherein the components thereof are constructed of rigid, synthetic matter.

20. The doorknob disabling device of claim 13, wherein the closed end of said retention member further defines an aperture of sufficient dimension to allow passage of a locking bolt.

* * * * *